US008074372B2

(12) United States Patent
Pucciani et al.

(10) Patent No.: US 8,074,372 B2
(45) Date of Patent: Dec. 13, 2011

(54) POWER DRYING SYSTEM

(75) Inventors: Allen S Pucciani, Beavercreek, OH (US); Steven E. Broerman, Cincinnati, OH (US)

(73) Assignee: Illinois Tool Works Inc., Glenview, IL (US)

( * ) Notice: Subject to any disclaimer, the term of this patent is extended or adjusted under 35 U.S.C. 154(b) by 670 days.

(21) Appl. No.: 12/104,057

(22) Filed: Apr. 16, 2008

(65) Prior Publication Data

US 2008/0276485 A1 Nov. 13, 2008

Related U.S. Application Data

(60) Provisional application No. 60/928,263, filed on May 8, 2007.

(51) Int. Cl.
*F26B 3/04* (2006.01)
*F26B 15/18* (2006.01)

(52) U.S. Cl. ..... 34/638; 34/644; 34/222; 34/229; 34/236

(58) Field of Classification Search ..... 34/500, 34/510, 587, 638, 640, 644, 222, 229, 236
See application file for complete search history.

(56) References Cited

U.S. PATENT DOCUMENTS

| | | | | |
|---|---|---|---|---|
| 1,910,868 A | | 5/1933 | Webb | |
| 2,067,891 A | * | 1/1937 | Comper | 5/624 |
| 2,132,303 A | * | 10/1938 | Lathrop | 34/105 |
| 2,978,216 A | * | 4/1961 | Sprouse et al. | 248/201 |
| 3,568,238 A | | 3/1971 | Fischer | |
| 4,292,745 A | * | 10/1981 | Caratsch | 34/644 |
| 5,050,232 A | * | 9/1991 | Bergman et al. | 392/412 |
| 5,555,649 A | * | 9/1996 | Phillipson | 34/666 |
| 5,582,440 A | * | 12/1996 | Pascaru | 285/373 |
| 6,098,904 A | | 8/2000 | Davidson | |
| 6,108,938 A | | 8/2000 | Jones | |

FOREIGN PATENT DOCUMENTS

FR 2497935 7/1982

OTHER PUBLICATIONS

Communication pursuant to Article 94(3) EPC for counterpart EP App. No. 08 747 280.9-1266, dated Jul. 23, 2010.

* cited by examiner

*Primary Examiner* — Jiping Lu
(74) *Attorney, Agent, or Firm* — Joseph M. Butscher; The Small Patent Law Group, LLC

(57) ABSTRACT

A system configured to dry containers before a date coding process includes a blower assembly, an air manifold and a bracket assembly. The blower assembly includes a centrifugal air blower. The air manifold is connected to the blower assembly and includes a plurality of air nozzles. The air nozzles are configured to be positioned over a conveyor line, wherein the air nozzles are configured to expel air moved by the centrifugal air blower. The bracket assembly is configured to adjustably mount the air manifold over the conveyor line, wherein the bracket assembly allows the air manifold to be horizontally and/or vertically adjusted with respect to the conveyor line.

20 Claims, 6 Drawing Sheets

POWER DRYING SYSTEM

RELATED APPLICATIONS

This application relates to and claims priority benefits from U.S. Provisional Patent Application No. 60/928,263 entitled "Power Drying System," filed May 8, 2007, which is hereby incorporated by reference in its entirety.

FIELD OF THE INVENTION

Embodiments of the present invention generally relate to a drying system and method, and more particularly to a power drying system and method that is configured to dry containers, such as cans, bottles or the like, before they are date coded.

BACKGROUND OF THE INVENTION

Various containers, such as beverage cans, canned foods and soft drink bottles, are date coded. Before the date code is printed on these containers, impurities and water are first blown off of them to ensure that the date code is firmly and accurately printed. Once the containers are dry and free of contaminants, they may be marked with date codes or the like.

Typically, many food and beverage plants blow water and other impurities off containers through various commercial compressed air driven nozzles. These nozzles typically consume larger amounts of compressed air and may be costly to operate over the course of a year.

SUMMARY OF THE INVENTION

Embodiments of the present invention provide an efficient system and method of removing water and impurities from outer surfaces of containers before a date code printing/marking process.

Certain embodiments of the present invention provide a system configured to dry containers before a date coding process. The system includes a blower assembly including a centrifugal air blower, an air manifold connected to the blower assembly and a bracket assembly configured to adjustably mount the air manifold over a conveyor line.

The air manifold includes a plurality of air nozzles, which may be aligned in a row, that are configured to be positioned over the conveyor line. The air nozzles are configured to expel air moved into the air manifold by the centrifugal air blower.

The bracket assembly is configured to adjustably mount the air manifold over the conveyor line. The bracket assembly allows the air manifold to be horizontally and/or vertically adjusted with respect to the conveyor line.

The bracket assembly may include a base configured to be secured to the conveyor line, at least one extension beam secured to the base, and at least one manifold bracket secured to the extension beam(s). The extension beam(s) is secured to the base through at least one first adjusting clamp, wherein the first adjusting clamp(s) is configured to be engaged to selectively loosen and tighten the extension beam(s) with respect to the base. The extension beam(s) is configured to be pivoted through a first range of motion with respect to the base when the first adjusting clamp(s) is loosened.

The manifold bracket(s) is secured to the extension beam (s) through at least one second adjusting clamp. The second adjusting clamp(s) is configured to be engaged to selectively loosen and tighten the manifold bracket(s) with respect to the extension beam(s). The manifold bracket(s) is configured to be pivoted through a second range of motion with respect to the extension beam(s) when the second adjusting clamp(s) is loosened.

The manifold bracket(s) may include a manifold passage that receives and retains a portion of the air manifold, and a cam lever configured to secure the air manifold within the manifold passage.

Certain embodiments of the present invention provide an apparatus configured to mount an air manifold over a conveyor line, wherein the conveyor line is configured to move containers to be dated coded. The apparatus may include a bracket assembly configured to adjustably mount the air manifold over the conveyor line. The bracket assembly allows the air manifold to be horizontally and/or vertically adjusted with respect to the conveyor line in order to accommodate containers of various sizes moved over the conveyor line.

The apparatus may include extension beams and a manifold bracket secured to each of the extensions beam through an adjusting clamp. The adjusting clamps are configured to be engaged to selectively loosen and tighten the manifold brackets with respect to the extension beams, wherein the manifold brackets are configured to be pivoted through a range of motion with respect to the extension beams when the adjusting clamps are loosened.

The apparatus may include a base configured to be secured to the conveyor line and extension beams secured to the base through first and second adjusting clamps. The first and second adjusting clamps are configured to be engaged to selectively loosen and tighten the extension beams with respect to the base. The extension beams are configured to be pivoted through a range of motion with respect to the base when the first and second adjusting clamps are loosened.

Figure 2:
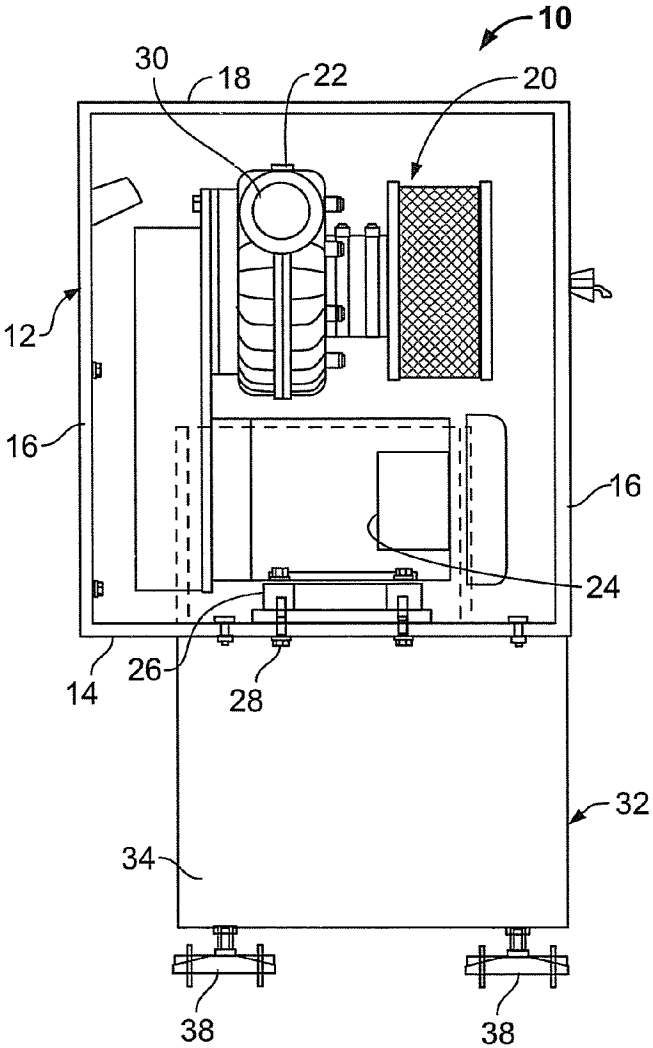
FIG. 2 illustrates an internal front view of a blower assembly according to an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

Figure 1:
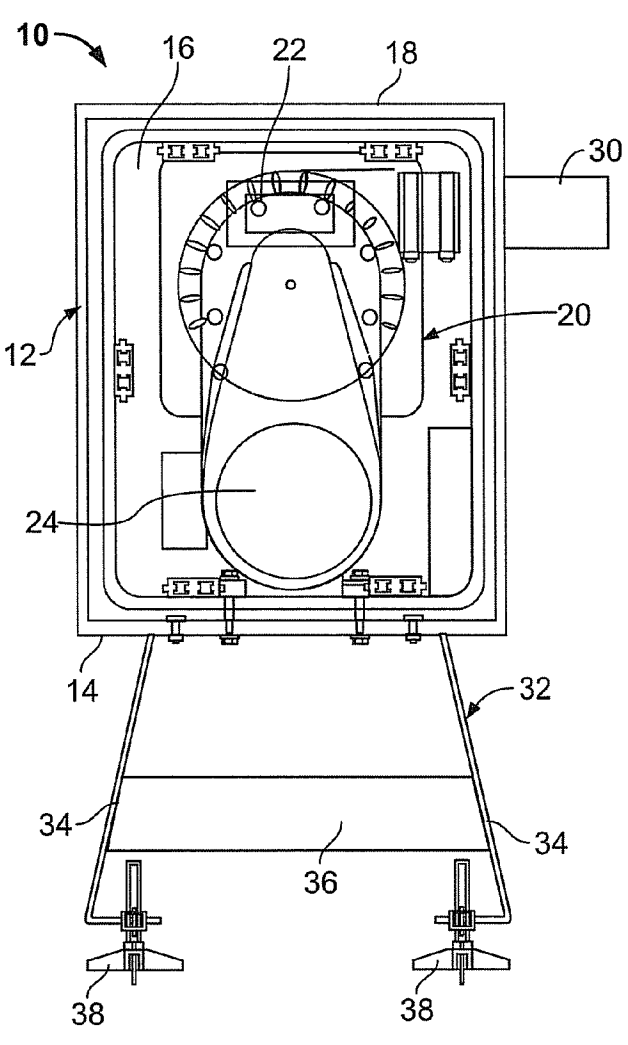
FIG. 1 illustrates an internal side view of a blower assembly according to an embodiment of the present invention.

FIGS. 1 and 2 illustrate internal side and front views, respectively, of a blower assembly 10 according to an embodiment of the present invention. Referring to FIGS. 1 and 2, the blower assembly 10 includes a blower enclosure or cover 12 having a bottom wall 14 integrally formed with lateral walls 16, which are in turn integrally formed with a top wall 18. Alternatively, the cover 12 may be a hood that is removably secured to a base or bottom wall 14. For example, the cover 12 may be latchably secured to the base or bottom wall 14.

The blower enclosure 12 may also include front and rear access doors, such as shown and described in U.S. patent application Ser. No. 11/545,244, entitled "Blower Enclosure," filed Oct. 10, 2006, which is hereby incorporated by reference in its entirety. The walls 14, 16, and 18, and the access door(s) define an internal chamber 20. A centrifugal blower 22 and a motor 24, such as an electric motor, are secured within the internal chamber 20. The blower 22 and the motor 24 may be secured to an interior surface of the bottom wall 14 through brackets 26 and fasteners 28. The blower 22 may be operatively connected to the motor 24 through belts, pulleys, and the like (not shown).

The blower 22 is, in turn, operatively connected to an outlet pipe 30 that is configured to deliver air from the blower 22 out of the blower assembly 10. The outlet pipe 30 may pass through a front wall (or any other wall) of the enclosure 12.

The enclosure 12 may be formed of polypropylene and may be secured to a base 32 including legs 34 connected by at least one cross beam 36. Adjustable feet 38 may be threadably secured to bottom surfaces of the legs 34. The adjustable feet 38 are configured to allow the four lower corners of the base 32 to be adjusted so that the blower assembly 10 may be leveled. The enclosure 12 protects the blower 22, the motor 24, and other internal components, such as air filters (not shown), from moisture and debris, as well as in wash-down environments and reduces sound levels to within OSHA standards.

Figure 3:
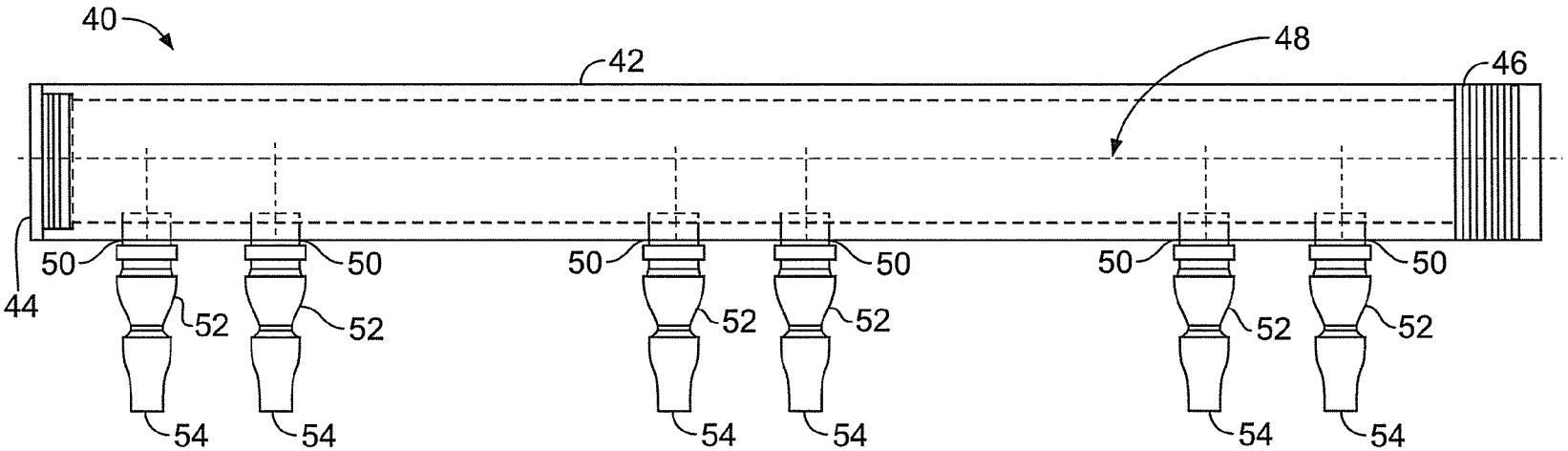
FIG. 3 illustrates a top view of an air manifold according to an embodiment of the present invention.
Figure 4:
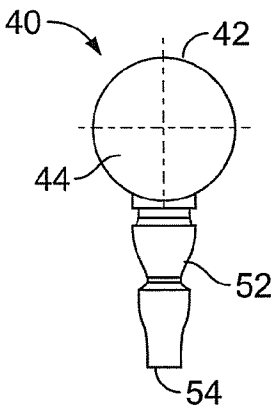
FIG. 4 illustrates an end view of an air manifold according to an embodiment of the present invention.

FIGS. 3 and 4 illustrate top and end views, respectively, of an air manifold 40 according to an embodiment of the present invention. The manifold 40 may be a tubular plenum formed of plastic, metal or various other materials. Referring to FIGS. 3 and 4, the manifold includes a main cylindrical body 42 having a closed end 44 and an open end 46. The open end 46 may be threaded to receive a reciprocal threaded end of an air duct (not shown in FIGS. 3 and 4). An internal chamber 48 is defined within the main cylindrical body 42.

The manifold 40 may include a plurality of threaded openings 50 that are configured to threadably retain ends of air nozzles 52. Optionally, the air nozzles 52 and manifold 40 may be integrally formed as a single piece. Distal ends 54 of the air nozzles 52 are open so that air may be passed from the manifold 40 into the air nozzles 52 and out through the distal ends 54. As shown in FIGS. 3 and 4, the distal ends 54 may be tapered to increase the pressure of air passing out of the air nozzles 52.

Figure 5:
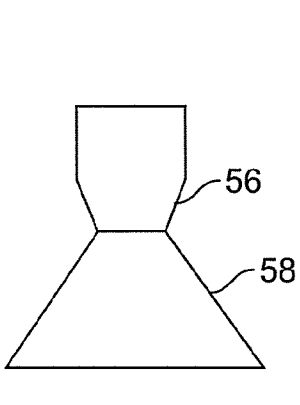
FIG. 5 illustrates a side view of an air nozzle according to an embodiment of the present invention.

The air nozzles 52 may be flared, round or various other shapes. FIG. 5 illustrates a side view of a round air nozzle 56 according to an embodiment of the present invention. The round air nozzle 56 includes an expanded distal end 58, thereby providing a wider stream of air. Round nozzles, such as the air nozzle 56, are particularly well-suited for drying the bottoms of aluminum cans.

Figure 6:
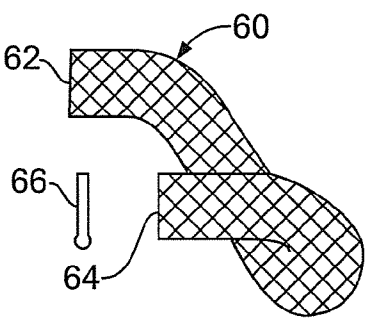
FIG. 6 illustrates a side view of a flexible air duct according to an embodiment of the present invention.

FIG. 6 illustrates a side view of a flexible air duct 60 according to an embodiment of the present invention. The air duct 60 is formed of a flexible material, such as rubber, flexible plastic, or the like. The air duct 60 may be a hose having open ends 62 and 64 connected by a central channel. The end 62 is configured to secure over or into the open end 46 (shown in FIG. 3) of the air manifold 40. For example, the end 62 may be internally threaded and threadably engage the open end 46 of the air manifold 40. Optionally, the end 62 may be clamped over the open end 46 through a clamping ring 66.

The end 64 is configured to secure over or into the outlet pipe 30 (shown in FIGS. 1 and 2) of the blower assembly 10. Thus, air may be forced from the blower assembly 10 (shown in FIGS. 1 and 2) into the air duct 60 and into the manifold 40 (shown in FIGS. 3 and 4).

Figure 8:
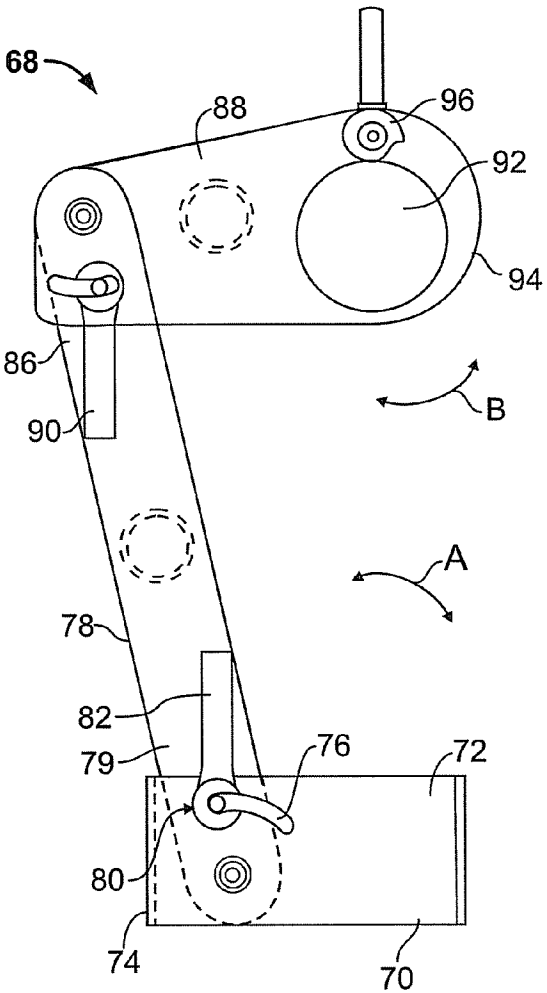
FIG. 8 illustrates a side view of a bracket assembly according to an embodiment of the present invention.
Figure 7:
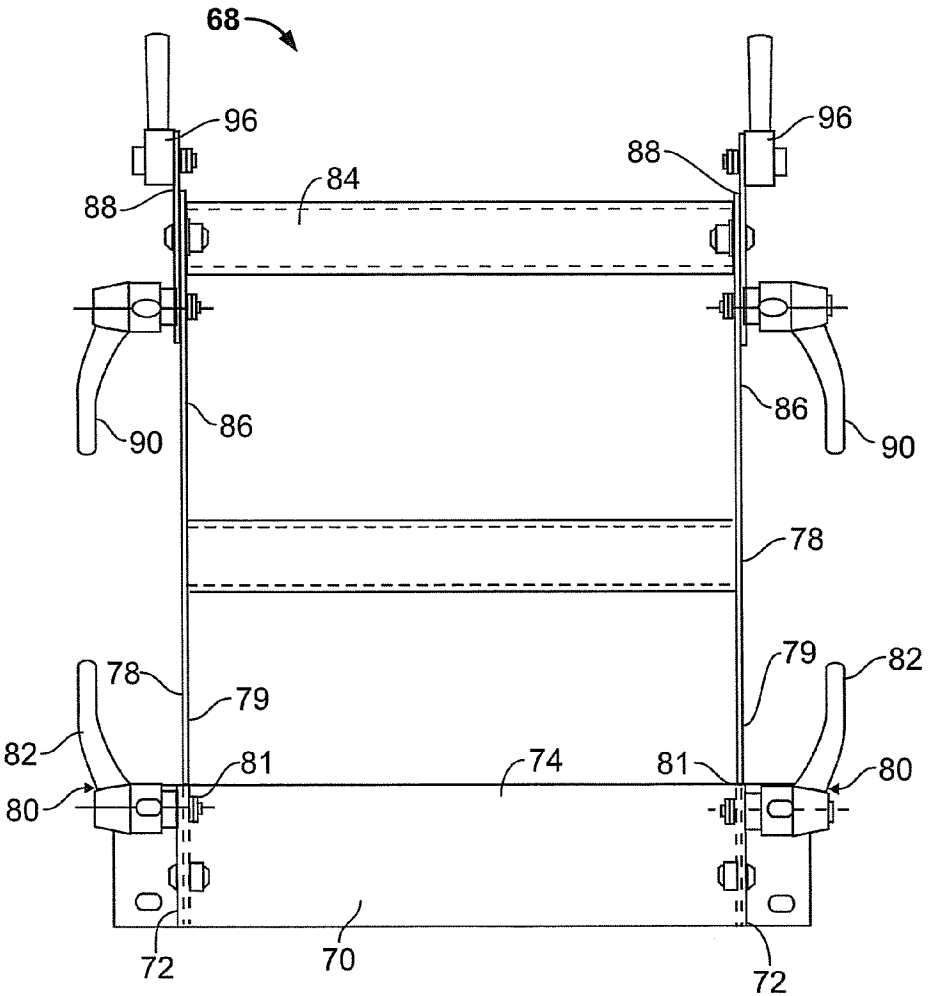
FIG. 7 illustrates a front view of a bracket assembly according to an embodiment of the present invention.

FIGS. 7 and 8 illustrate front and side views, respectively, of a bracket assembly 68. Referring to FIGS. 7 and 8, the bracket assembly 68 includes a base 70 that is configured to be secured to a conveyor line (not shown in FIGS. 7 and 8) through fasteners. The base 70 includes lateral walls 72 connected to a rear wall 74. The lateral walls 72 include aligned arcuate paths 76 formed through upper rear ends. Extension beams 78 are connected to the lateral walls 72 through adjusting clamps 80. The adjusting clamps 80 include fasteners 81 integrally connected to levers 82. The fasteners 81 pass through the arcuate paths 76 and are secured to lower ends 79 of the extension beams 78, thereby securing the extension beams 78 to the lateral walls 72. The levers 82 may be engaged to selectively tighten and loosen the engaging interface between the extension beams 78 and the lateral walls 72. When loosened, the extension beams 78 may be pivoted with respect to the laterals walls 72 in the directions of arc A. The levers 82 may then be engaged to secure the extension beams 78 in position at a desired location along arc A. The extension beams 78 may be connected together by one or more cross beams, rods or the like 84.

Upper ends 86 of the extension beams 78 are secured to aligned manifold brackets 88. The manifold brackets 88 may be separate and distinct from one another, or they may be connected through a beam or the like. The upper ends 86 of the extension beams 78 are pivotally secured to the manifold brackets 88 through adjusting clamps 90, similar to the adjusting clamps 80. The adjusting clamps 90 allow the manifold brackets 88 to pivot relative to the upper ends 86 of the extension beams 78 in the directions of arc B.

Manifold passages 92 are formed through distal ends 94 of the manifold brackets 88 and are configured to receive and retain the air manifold 40 (shown in FIGS. 3 and 4). Cam levers 96 are configured to secure the manifold 40 in place. That is, the cam levers 96 may be tightened to secure the manifold 40 into the manifold passages 92, and loosened to allow the manifold 40 to be removed from the manifold passages 92.

When the manifold 40 is secured within the manifold brackets 88, the position of the manifold 40 may be adjusted through a range of positions. That is, the adjusting clamps 78 may be engaged to move the extension beams 78 through a range of motion denoted by arc A, while the manifold bracket 88 may be moved through directions relative to the upper ends 86 of the extension beams 78 through the adjusting clamps 90.

Figure 9:
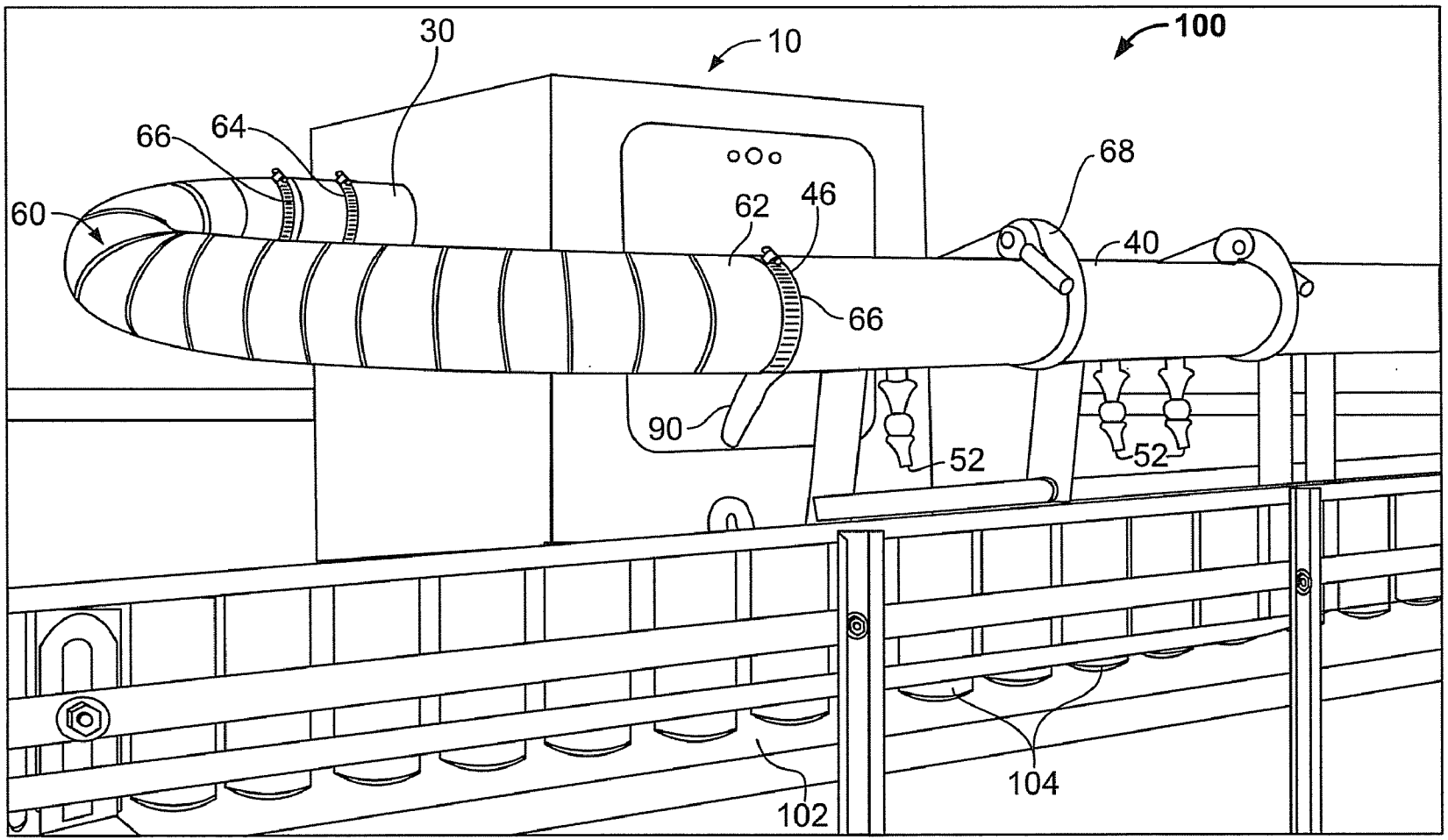
FIG. 9 illustrates an isometric front view of a power drying system according to an embodiment of the present invention.
Figure 10:
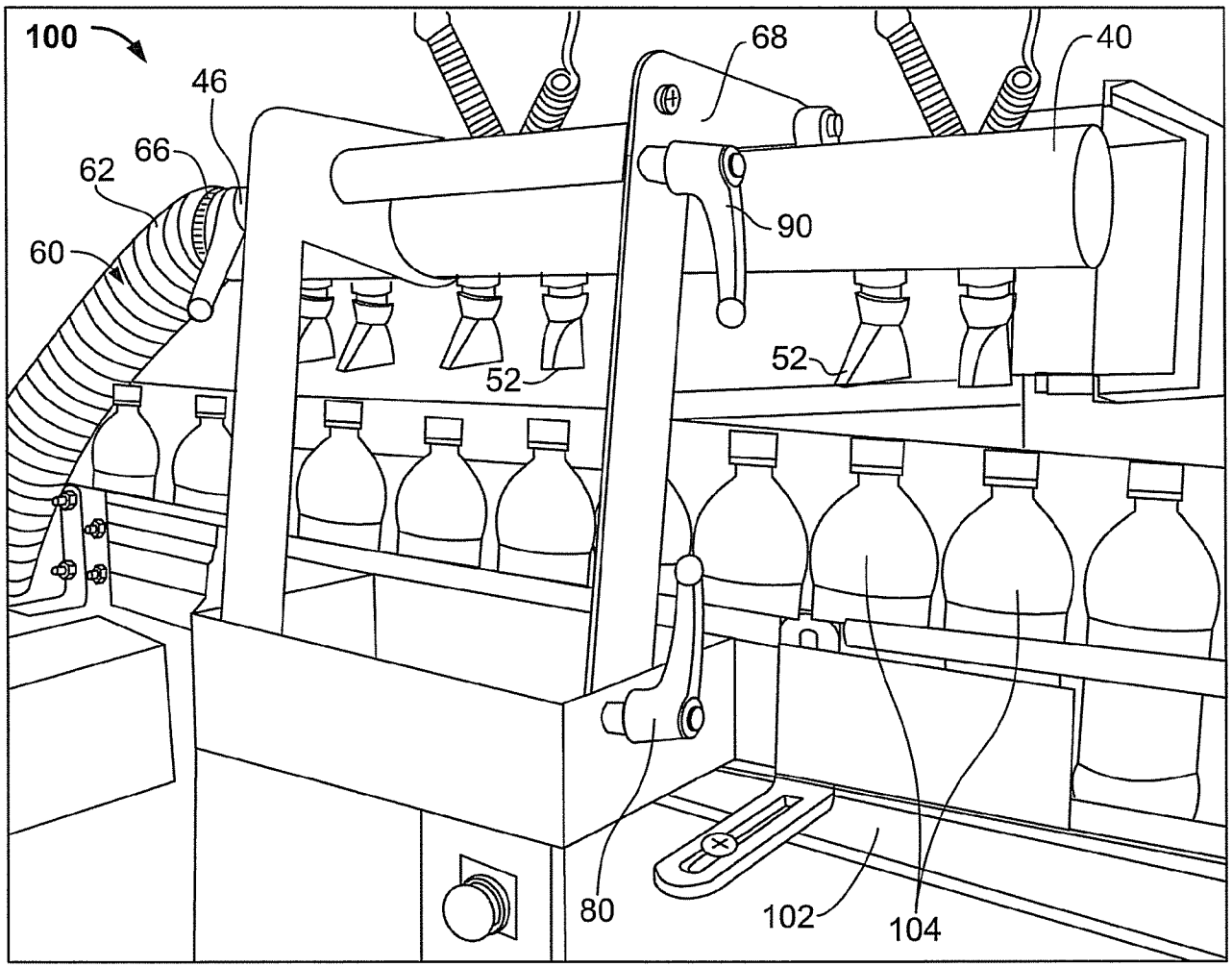
FIG. 10 illustrates an isometric rear view of a power drying system according to an embodiment of the present invention.

FIGS. 9 and 10 illustrate isometric front and rear views, respectively, of a power drying system 100 according to an embodiment of the present invention. Referring to FIGS. 9 and 10, the power drying system 100 includes the blower assembly 10 (not shown in FIG. 10) positioned relative to a conveyor line 102. The conveyor line 102 moves containers 104, such as cans or bottles, past the blower assembly 10 and underneath the air manifold 40. The air manifold 40 is mounted on the conveyor line 102 upstream of a date coding assembly (not shown).

The outlet pipe 30 of the blower assembly is connected to the end 64 of the air duct 60, while the end 62 is secured to the open end 46 of the air manifold 40. The air duct 60 may be secured to the outlet pipe 30 and the air manifold 40 through clamping rings 66.

The air manifold 40 is securely positioned over the conveyor line 102 through the bracket assembly 68. The base 70 of the bracket assembly 68 may be securely fastened, such as through screws, to a lateral wall of the conveyor line 102. The plurality of air nozzles 52 expel air supplied from the blower assembly 10 down onto the containers 104 passing on the conveyor line 102, thereby blowing off moisture and/or contaminants. The air manifold 40 may be adjusted through a variety of positions by way of the adjusting clamps 80 and 90, as discussed above with respect to FIGS. 7 and 8. Thus, the air manifold 40 may be adjusted depending upon the size of the containers 104 passing underneath.

The containers 104 pass under each of the nozzles 52. Thus, if the first nozzle 52 that a container 104 encounters does not completely dry the area to be date coded on the container, the nozzles 52 downstream from the initial nozzle 52 ensure that the relevant area is dry.

As demonstrated above, embodiments of the present invention provide a more efficient system and method of removing water and impurities from containers before a date code printing/marking process. The blower assembly 10 provides relatively low pressure, high volume air that is ducted through the air duct 60 to the air manifold 40, which is then expelled through the air nozzles 52, thereby blowing water and impurities off the containers 104. Once water and impurities are removed from the containers 104, date codes may be accurately printed on the containers 104. The bracket assembly 68 allows the air manifold 40 to be adjusted vertically (e.g., the mounting brackets 88 pivoting with respect to the upper ends 86 of the extension members 78) and horizontally (e.g., the extension beams 78 pivoting with respect to the base 70) with respect to the conveyor line 102 so that the air nozzles 52 may be positioned in close proximity to the area where the containers 104 will be marked with date codes. Once the air manifold 40 is pivoted to an appropriate position, the air manifold 40 is locked in place through the adjusting clamps 80 and 90.

Figure 11:
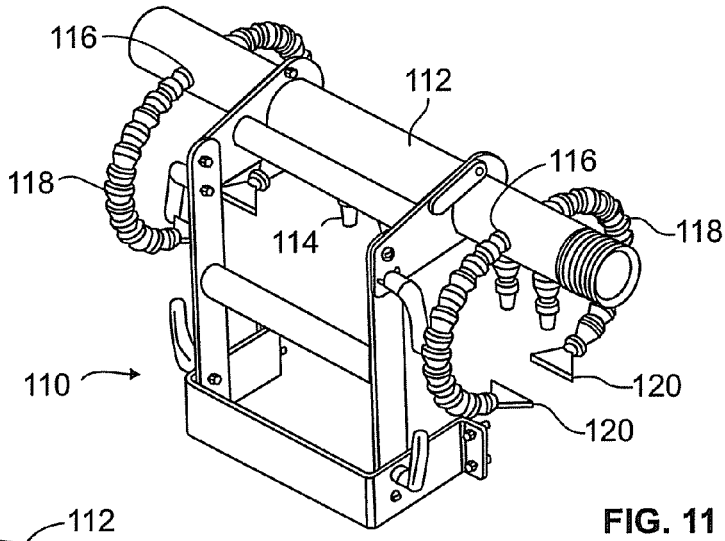
FIG. 11 illustrates an isometric top view of a bracket assembly securing an air manifold according to an embodiment of the present invention.
Figure 12:
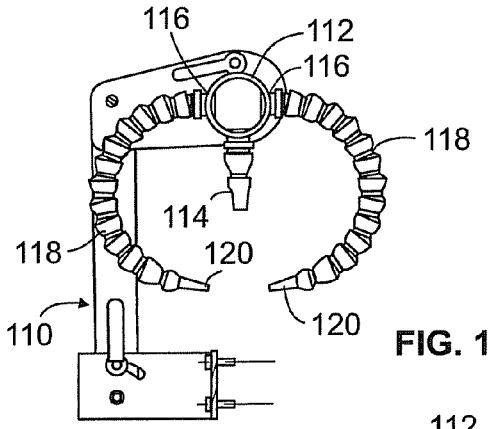
FIG. 12 illustrates a side view of a bracket assembly securing an air manifold according to an embodiment of the present invention.
Figure 13:
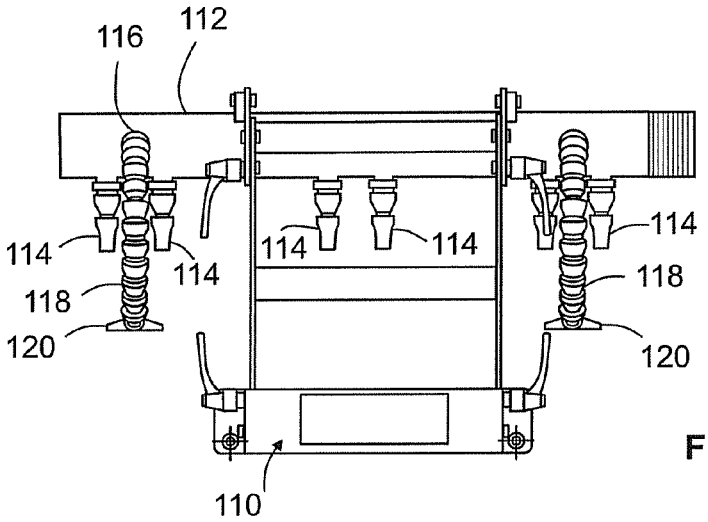
FIG. 13 illustrates a front view of a bracket assembly securing an air manifold according to an embodiment of the present invention.

FIGS. 11, 12 and 13 illustrate, respectively, an isometric top view, a side view and a front view of a bracket assembly 110 securing an air manifold 112 according to an embodiment of the present invention. Referring to FIGS. 11-13, the bracket assembly 110 is generally the same as the bracket assembly 68 shown and described with respect to FIGS. 7-10. The air manifold 112 includes a plurality of air nozzles 114 that are configured to be oriented above a conveyor line, as discussed above. The air manifold 112 also includes air outlets 116 at either end. Flexible air conduits 118 are secured within the air outlets 116. Because the air conduits 118 are flexible, they may be fashioned to bow out, as shown in FIGS. 11-13, such that opposing air nozzles 120 will straddle containers passing underneath on a conveyor line.

While the conduits 118 may be flexible, they may alternatively be rigidly fixed in the positions shown in FIGS. 11-13. The air nozzles 120 may be similar to the air nozzles 56 shown and described with respect to FIG. 5 or may be similar to the air nozzles 52 shown and described with respect to FIG. 3.

In operation, the air nozzles 114 dry the top portions of containers passing underneath on a conveyor line, while the air nozzles 120 are directed towards the sides of the containers. While the conduits 118 and nozzles 120 are shown at ends of the air manifold 112, additional conduits may be positioned at various other positions of the manifold. For example, conduits 118 may be positioned at the middle of the air manifold 112 in addition to, or in lieu of, the conduits 118 at the ends of the air manifold 112.

Thus, embodiments of the present invention provide an efficient and cost-effective system and method of removing water and impurities from containers before date code printing. Embodiments of the present invention provide a system and method that may save an operator operating costs, when compared to conventional commercial compressed air driven nozzles.

Embodiments of the present invention provide a power drying system having a position selectable bracket assembly 68 that allows the air manifold 40 to be adjusted over the product conveyor line 102. As such, the air manifold 40 may be adjusted to accommodate containers 104 of various shapes and sizes.

While various spatial and directional terms, such as top, bottom, lower, mid, lateral, horizontal, vertical, front and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A system configured to dry containers before a date coding process, the system comprising:

a blower assembly comprising a centrifugal air blower;

an air manifold connected to said blower assembly, said air manifold comprising a plurality of air nozzles, said plurality of air nozzles configured to be positioned over a conveyor line, wherein said air nozzles are configured to expel air moved by said centrifugal air blower; and a bracket assembly configured to adjustably mount said air manifold over the conveyor line, wherein said bracket assembly allows said air manifold to be horizontally and/or vertically adjusted with respect to the conveyor line, wherein said bracket assembly includes:

a base configured to be secured to the conveyor line; and at least one extension beam secured to said base through at least one first adjusting clamp, wherein said at least one first adjusting clamp is configured to be engaged to selectively loosen and tighten said at least one extension beam with respect to said base, wherein said at least one extension beam is configured to be pivoted through a first range of motion with respect to said base when said at least one first adjusting clamp is loosened, and wherein said bracket assembly further includes at least one manifold bracket secured to said at least one extension beam through at least one second adjusting clamp, wherein said at least one second adjusting clamp is configured to be engaged to selectively loosen and tighten said at least one manifold bracket with respect to said at least one extension beam, wherein said at least one manifold bracket is configured to be pivoted through a second range of motion with respect to said at least one extension beam when said at least one second adjusting clamp is loosened.

2. The system of claim 1, wherein said at least one manifold bracket comprises:

a manifold passage that receives and retains a portion of said air manifold; and a cam lever configured to secure said air manifold within said manifold passage.

3. The system of claim 1, wherein said blower assembly comprises a motor operatively connected to said centrifugal air blower.

4. The system of claim 1, comprising a flexible air duct having first and second ends, wherein said first end is connected to an outlet pipe of said blower assembly and said second end is connected to an open end of said air manifold.

5. The system of claim 1, wherein each of said air nozzles comprises a tapered distal end.

6. The system of claim 1, wherein each of said air nozzles comprises a rounded distal end.

7. The system of claim 1, wherein said plurality of air nozzles are aligned in a row.

8. The system of claim 1, comprising additional air nozzles configured to straddle containers passing by on the conveyor line.

9. A system comprising a bracket assembly, an air manifold, and a conveyor line, wherein said bracket assembly mounts said air manifold over said conveyor line, wherein said bracket assembly allows said air manifold to be horizontally and/or vertically adjusted with respect to said conveyor line, wherein said bracket assembly includes:

a base secured to said conveyor line; and extension beams secured to said base through first and second adjusting clamps, wherein said first and second adjusting clamps are configured to be engaged to selectively loosen and tighten said extension beams with respect to said base, wherein said extension beams are configured to be pivoted through a range of motion with respect to said base when said first and second adjusting clamps are loosened.

10. The system of claim 9, comprising:

a manifold bracket secured to each of said extension beams through a third adjusting clamp, wherein said third adjusting clamp is configured to be engaged to selectively loosen and tighten said manifold brackets with respect to said extension beams, wherein said manifold bracket is configured to be pivoted through a range of motion with respect to said extension beams.

11. The system of claim 10, wherein said manifold bracket comprises:

a manifold passage that receives and retains a portion of said air manifold; and a cam lever configured to secure said air manifold within said manifold passage.

12. A system configured to dry containers before a date coding process, the system comprising:

a conveyor line configured to move a plurality of containers;

a blower assembly comprising a centrifugal air blower;

an air manifold connected to said blower assembly, said air manifold comprising a plurality of air nozzles, said air nozzles configured to be positioned proximate said conveyor line, wherein said air nozzles are configured to expel air moved by said centrifugal air blower; and a bracket assembly configured to adjustably mount said air manifold over said conveyor line, wherein said bracket assembly allows said air manifold to be horizontally and/or vertically adjusted with respect to said conveyor line, said bracket assembly comprising:

a base configured to be secured to said conveyor line;

extension beams having first and second ends, wherein said first ends are secured to said base through first and second adjusting clamps, wherein said first and second adjusting clamps are configured to be engaged to selectively loosen and tighten said extension beams with respect to said base, wherein said extension beams are configured to be pivoted through a first range of motion with respect to said base when said first and second adjusting clamps are loosened; and manifold brackets secured to second ends of said extensions beam through third and fourth adjusting clamps, wherein said third and fourth adjusting clamps are configured to be engaged to selectively loosen and tighten said manifold brackets with respect to said extension beams, wherein said manifold brackets are configured to be pivoted through a second range of motion with respect to said extension beams when said adjusting clamps are loosened.

13. The system of claim 12, wherein each of said manifold brackets comprises:

a manifold passage that receives and retains a portion of said air manifold; and a cam lever configured to secure said air manifold within said manifold passage.

14. The system of claim 12, wherein said blower assembly comprises a motor operatively connected to said centrifugal air blower.

15. The system of claim 12, comprising a flexible air duct having first and second ends, wherein said first end is connected to an outlet pipe of said blower assembly and said second end is connected to an open end of said air manifold.

16. The system of claim 12, wherein each of said air nozzles comprises a tapered distal end.

17. The system of claim 12, wherein each of said air nozzles comprises a rounded distal end.

18. The system of claim 12, wherein said plurality of air nozzles are aligned in a row over said conveyor line.

19. The system of claim 12, wherein said plurality of air nozzles are configured to be positioned over and/or straddling the plurality of containers passing by on said conveyor line.

20. A system comprising a bracket assembly, an air manifold, and a conveyor line, wherein said bracket assembly adjustably mounts said air manifold over said conveyor line, wherein said bracket assembly allows said air manifold to be horizontally and/or vertically adjusted with respect to said conveyor line, wherein said bracket assembly includes:

a base secured to said conveyor line; and extension beams secured to said base through first and second adjusting clamps, wherein said extension beams have first and second ends, wherein said first ends are secured to said base through said first and second adjusting clamps, wherein said first and second adjusting clamps are configured to be engaged to selectively loosen and tighten said extension beams with respect to said base, wherein said extension beams are configured to be pivoted through a first range of motion with respect to said base when said first and second adjusting clamps are loosened; and manifold brackets secured to second ends of said extensions beam through third and fourth adjusting clamps, wherein said third and fourth adjusting clamps are configured to be engaged to selectively loosen and tighten said manifold brackets with respect to said extension beams, wherein said manifold brackets are configured to be pivoted through a second range of motion with respect to said extension beams when said adjusting clamps are loosened.

* * * * *